US007339556B2

(12) United States Patent
Kim et al.

(10) Patent No.: US 7,339,556 B2
(45) Date of Patent: Mar. 4, 2008

(54) METHOD FOR DRIVING DISCHARGE DISPLAY PANEL BASED ON ADDRESS-DISPLAY MIXED SCHEME

(75) Inventors: Jin-Sung Kim, Cheonan-si (KR); Woo-Joon Chung, Asan-si (KR); Seung-Hun Chae, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 556 days.

(21) Appl. No.: 11/046,768

(22) Filed: Feb. 1, 2005

(65) Prior Publication Data

US 2005/0168409 A1 Aug. 4, 2005

(30) Foreign Application Priority Data

Feb. 2, 2004 (KR) ..... 10-2004-0006587

(51) Int. Cl.
*G09G 3/28* (2006.01)
*G09G 5/10* (2006.01)

(52) U.S. Cl. ..... 345/60; 345/63; 345/690; 345/204

(58) Field of Classification Search ..... 345/63–69, 345/204, 692, 690, 211–212
See application file for complete search history.

(56) References Cited

U.S. PATENT DOCUMENTS 5,436,634 A * 7/1995 Kanazawa ..... 345/67
5,541,618 A 7/1996 Shinoda ..... 345/60
6,337,674 B1 * 1/2002 Kim ..... 345/66

* cited by examiner

*Primary Examiner*—Duc Q Dinh
(74) *Attorney, Agent, or Firm*—H.C. Park & Associates, PLC

(57) ABSTRACT

In a panel driving method, first and second type sub-fields comprise at least two sub-fields in a unit frame. At least one of the first type sub-fields sequentially includes an addressing period for a first display electrode line group, a display-sustain period for the first display electrode line group, an addressing period for a second display electrode line group, and a display-sustain period for the first and second display electrode line groups. At least one of the second type sub-fields sequentially includes an addressing period for the second display electrode line group, a display-sustain period for the second display electrode line group, an addressing period for the first display electrode line group, and a display-sustain period for the first and second display electrode line groups. Moreover, the display-sustain periods of at least two of sub-fields in the unit frame are equal to each other.

19 Claims, 9 Drawing Sheets

METHOD FOR DRIVING DISCHARGE DISPLAY PANEL BASED ON ADDRESS-DISPLAY MIXED SCHEME

CROSS REFERENCE TO RELATED APPLICATION

This application claims priority to and the benefit of Korean Patent Application No. 10-2004-0006587, filed on Feb. 2, 2004, which is hereby incorporated by reference for all purposes as if fully set forth herein.

BACKGROUND OF THE INVENTION

1. Field of the Invention

The present invention relates to a method for driving a discharge display panel, and more particularly, to a method of driving a discharge display panel which performs a gray scale display operation of a unit frame including a plurality of sub-fields with a time-sharing driving scheme.

2. Description of the Background

FIG. 1 shows a structure of a conventional three-electrode surface discharge type plasma display panel (PDP) as an example of a typical discharge display panel. FIG. 2 shows a display cell of the panel shown in FIG. 1. Referring to FIG. 1 and FIG. 2, address electrode lines $A_{R1}, A_{G1}, \ldots, A_{Gm}$, and $A_{Bm}$, dielectric layers 11 and 15, Y-electrode lines $Y_1, \ldots, Y_n$, X-electrode lines $X_1, \ldots, X_n$, fluorescent layers 16, barrier ribs 17, and a protective layer 12 are formed between front and rear glass substrates 10 and 13 of a typical surface discharge PDP 1.

The address electrode lines $A_{R1}, A_{G1}, \ldots, A_{Gm}$, and $A_{Bm}$ are formed in a pattern on the front side of the rear glass substrate 13, and a lower dielectric layer 15 covers them. The barrier ribs 17 are formed on the lower dielectric layer 15 and in parallel with, and in between, the address electrode lines $A_{R1}, A_{G1}, \ldots, A_{Gm}$, and $A_{Bm}$. The barrier ribs 17 define display cells and prevent optical crosstalk between the display cells. The fluorescent layers 16 are formed between the barrier walls 17.

The X-electrode lines $X_1, \ldots, X_n$ and Y-electrode lines $Y_1, \ldots, Y_n$, which constitute display electrode line pairs, are formed orthogonally to the address electrode lines $A_{R1}$, $A_{G1}, \ldots, A_{Gm}$, and $A_{Bm}$ on the rear side of the front glass substrate 10. A display cell corresponds to each intersection of the address electrodes and the X and Y electrode pairs. The X-electrode lines $X_1, \ldots, X_n$, and the Y-electrode lines $Y_1, \ldots, Y_n$ may comprise transparent electrode lines $X_{na}$ and $Y_{na}$, which are made of a transparent material such as indium-tin-oxide (ITO), and metal electrode lines $X_{nb}$ and $Y_{nb}$, which improve conductivity. The front dielectric layer 11 covers the X-electrode lines $X_1, \ldots, X_n$ and the Y-electrode lines $Y_1, \ldots, Y_n$. The protective layer 12, which protects the panel 1 from a strong electric field, may be made of an MgO layer, and it covers the front dielectric layer 11. A plasma-creating gas is sealed within a discharge space 14.

In a conventional driving method for the PDP described above, reset, address, and display-sustain operations may be sequentially performed in a unit sub-field. In the reset operation, all display cells are set to a uniform electric charge state. In the addressing operation, a fixed wall voltage is created on the selected display cells. In the display-sustain operation, applying an alternating voltage to all XY-electrode line pairs generates a display-sustain discharge in the selected display cells. The display-sustain operation creates plasma in the discharge space 14, i.e., a gas layer, of the selected display cells, and radiated ultraviolet rays excite the fluorescent layers 16 to emit light.

FIG. 3 shows a typical device for driving the PDP 1 of FIG. 1. The device comprises an image processing unit 66, a control unit 62, an address driving unit 63, an X-driving unit 64, and a Y-driving unit 65. The image processing unit 66 converts external analog image signals into internal digital image signals, such as red (R), green (G), and blue (B) image data, each of which may have 8 bits, a clock signal, and vertical and horizontal synchronous signals. The control unit 62 generates driving control signals $S_A$, $S_Y$, and $S_X$ according to the internal image signals input from the image processing unit 66. The address driving unit 63 processes the address signal $S_A$ to generate a display data signal, and applies the generated display data signal to the address electrode lines. The X-driving unit 64 processes the X-driving control signal $S_X$ and applies the processed signal to the X-electrode lines. The Y driving unit 65 processes the Y driving control signal $S_Y$ and applies the processed signal to the Y-electrode lines.

U.S. Pat. No. 5,541,618 discloses an address-display separation driving method of driving the PDP 1. In this driving method, each sub-field included in a unit frame may comprise separate addressing and display-sustain periods. Accordingly, addressed display cells of an XY-electrode line pair are not sustain discharged until the addressing operation is completed for all display cells of other XY-electrode line pairs. This delay between addressing and sustain discharging may deteriorate the wall charge state of the addressed display cells, thereby reducing the accuracy of the display-sustain discharge.

SUMMARY OF THE INVENTION

The present invention provides a method for driving a discharge display panel that may improve the accuracy of a display-sustain discharge in the display-sustain period by reducing a waiting period between addressing and display-sustain discharging.

The present invention also provides a method for driving a discharge display panel that may reduce a possibility of pseudo-contour noise occurring.

Additional features of the invention will be set forth in the description which follows, and in part will be apparent from the description, or may be learned by practice of the invention.

The present invention discloses a method for driving a discharge display panel that performs a gray scale display operation of a unit frame including a plurality of sub-fields with a time-sharing driving scheme, where the panel comprises display electrode line pairs in parallel to each other and address electrode lines separated from and crossing the display electrode line pairs. The method comprises driving display electrode line pairs grouped by at least a first display electrode line group and a second display electrode line group so that at least one display electrode line pair is included in a display electrode line group. Here, the unit frame comprises at least a first and second type sub-field. At least one of the first type sub-field sequentially comprises an addressing period for the first display electrode line group, a display-sustain period for the first display electrode line group, an addressing period for the second display electrode line group, and a display-sustain period for the first and second display electrode line groups. At least one of the second type sub-field sequentially comprises an addressing period for the second display electrode line group, a display-sustain period for the second display electrode line group, an addressing period for the first display electrode line group, and a display-sustain period for the first and second display electrode line groups. Moreover, the display-sustain periods of at least two sub-fields in the unit frame are equal to each other.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE INVENTION

Figure 1:
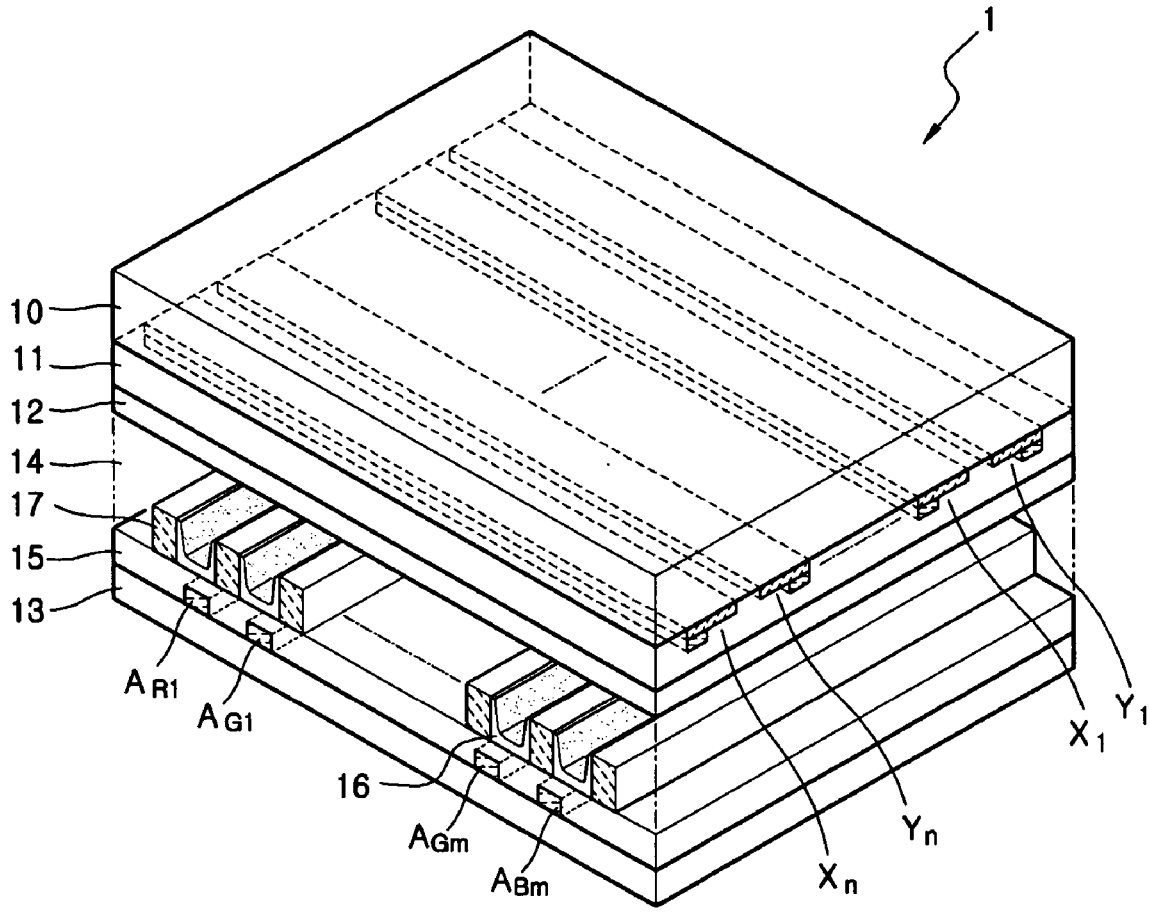
FIG. 1 (RELATED ART)
FIG. 1 is an internal perspective view showing a structure of a conventional three-electrode surface discharge type PDP.
Figure 2:
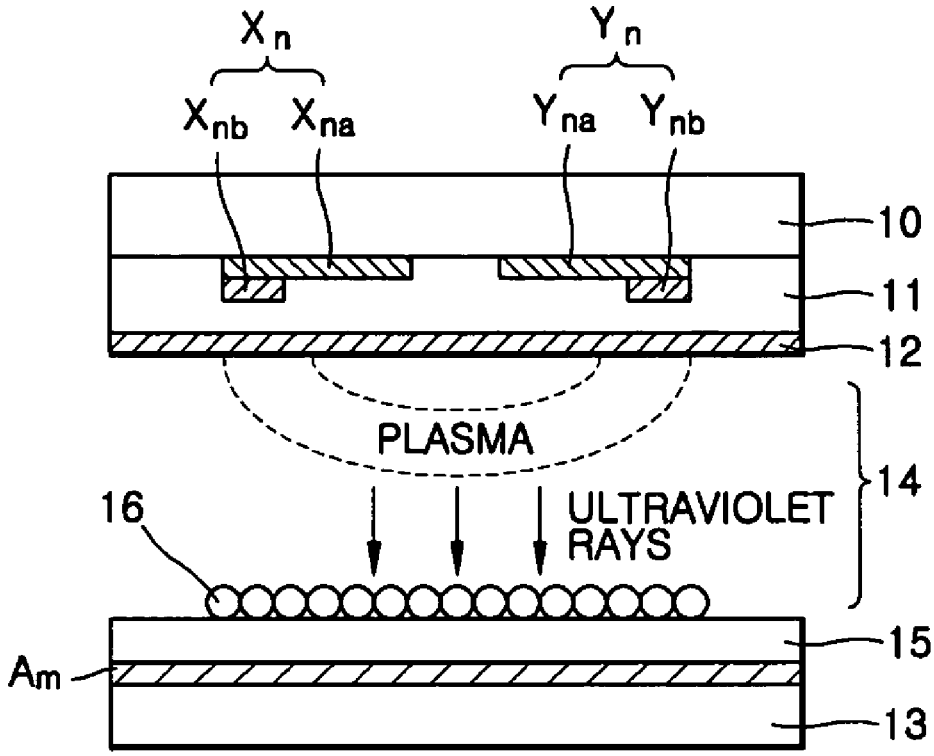
FIG. 2 (RELATED ART)
FIG. 2 is a sectional view showing a display cell of the PDP shown in FIG. 1.

Exemplary embodiments of the present invention will now be described in detail with reference to the accompanying drawings. Like reference numerals in the drawings denote like elements.

Figure 4:
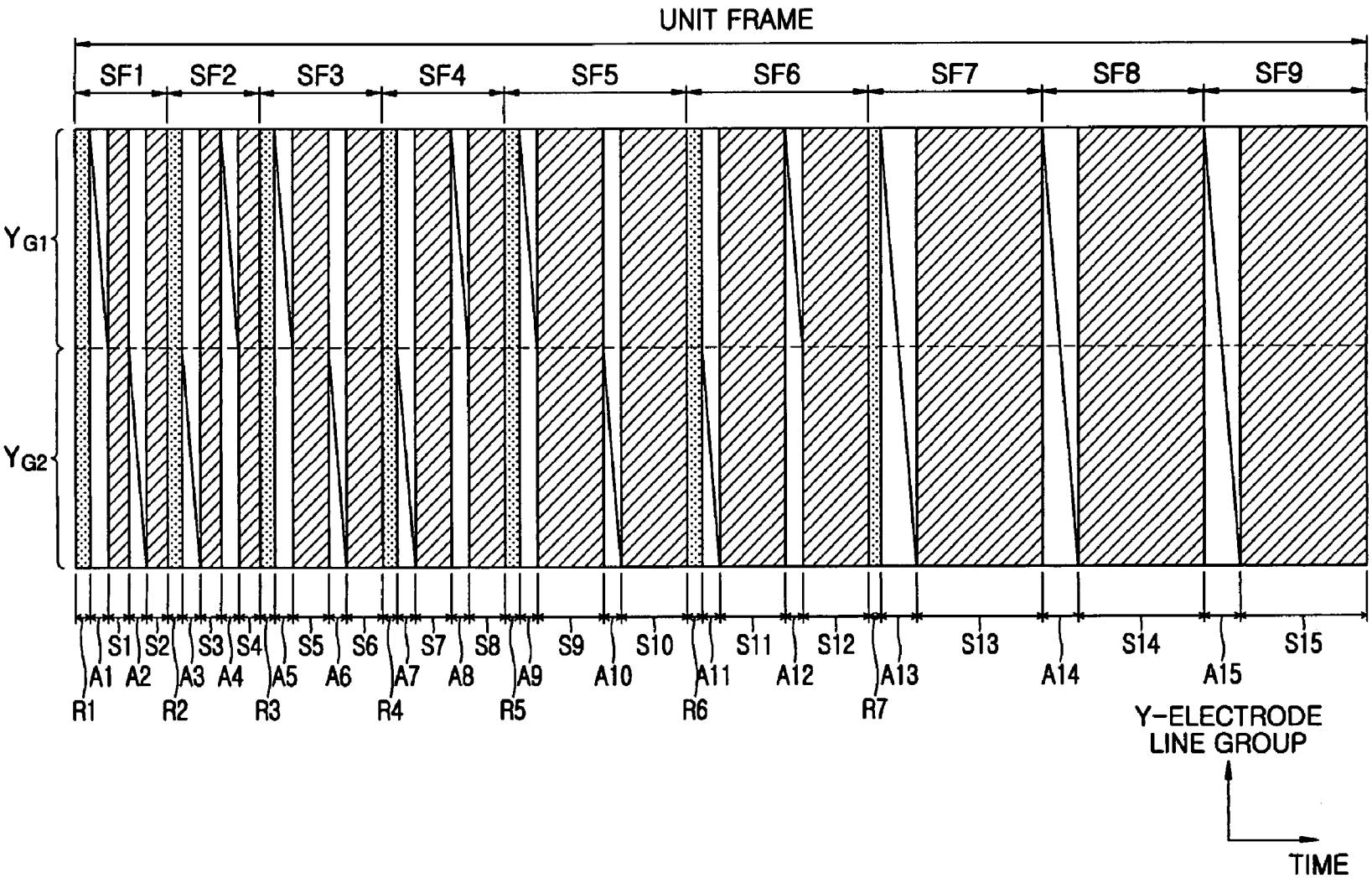
FIG. 4 is a timing diagram showing a unit frame for use in an address-display mixed driving method according to an exemplary embodiment of the present invention.

FIG. 4 shows a unit frame that may be used in an address-display mixed driving method according to an exemplary embodiment of the present invention. SF1 through SF9 denote sub-fields allocated within the unit frame, $Y_{G1}$ denotes a first Y-electrode line group, which is a first display electrode line group including odd-numbered Y-electrode lines, $Y_{G2}$ denotes a second Y-electrode line group, which is a second display electrode line group including even-numbered Y-electrode lines, R1 through R7 denote reset periods, A1 through A15 denote addressing periods, and S1 through S15 denote display-sustain periods. The first and second display electrode line groups $Y_{G1}$ and $Y_{G2}$ have an equal total sustain period per unit frame.

First-type sub-fields SF1, SF3, and SF5 respectively and sequentially include the reset period R1, R3, and R5 for the first and second display electrode line groups $Y_{G1}$ and $Y_{G2}$, the addressing period A1, A5, and A9 for the first display electrode line group $Y_{G1}$, the display-sustain period S1, S5, and S9 for the first display electrode line group $Y_{G1}$, the addressing period A2, A6, and A10 for the second display electrode line group $Y_{G2}$, and the common display-sustain period S2, S6, and S10 for the first and second display electrode line groups $Y_{G1}$ and $Y_{G2}$.

Additionally, second-type sub-fields SF2, SF4, and SF6 respectively and sequentially include the reset period R2, R4, and R6 for the first and second display electrode line groups $Y_{G1}$ and $Y_{G2}$, the addressing period A3, A7, and A11 for the second display electrode line group $Y_{G2}$, the display-sustain period S3, S7, and S11 for the second display electrode line group $Y_{G2}$, the addressing period A4, A8, and A12 for the first display electrode line group $Y_{G1}$, and the common display-sustain period S4, S8, and S12 for the first and second display electrode line groups $Y_{G1}$ and $Y_{G2}$.

Using the first and second-type sub-fields in the first through sixth sub-fields SF1 through SF6 may obtain the following effects.

In the first-type sub-fields SF1, SF3, and SF5, after completing an addressing operation for the first display electrode line group $Y_{G1}$, a display-sustain discharge operation is performed for the first group before performing an addressing operation for the second display electrode line group $Y_{G2}$. Similarly, in the second-type sub-fields SF2, SF4, and SF6, after completing an addressing operation for the second display electrode line group $Y_{G2}$, a display-sustain discharge operation is performed for the second group before performing an addressing operation for the first display electrode line group $Y_{G1}$. Consequently, due to the reduced waiting period in which addressed display cells of an XY-electrode line pair wait until all display cells of other XY-electrode line pairs are addressed, the accuracy of a display-sustain discharge may increase in the display-sustain period started after the addressing period.

The operation of the first-type sub-fields SF1, SF3, and SF5 is now set forth.

The reset periods R1, R3 and R5 provide substantially uniform electric charges for all display cells.

The addressing periods A1, A5, and A9 generate a fixed wall voltage for selected display cells of the first display electrode line group $Y_{G1}$. In the display-sustain periods S1, S5, and S9 for the first display electrode line group $Y_{G1}$, applying a fixed alternating voltage to the odd-numbered XY-electrode line pairs of the addressed first display electrode line group $Y_{G1}$ may cause a display-sustain discharge in the display cells selected in addressing period A1, A5, and A9. Similarly, the addressing periods A2, A6, and A10 generate a fixed wall voltage for selected display cells of the second display electrode line group $Y_{G2}$. In the common display-sustain periods S2, S6, and S10 for the first and second display electrode line groups $Y_{G1}$ and $Y_{G2}$, applying a fixed alternating voltage to the odd-numbered XY-electrode line pairs of the first display electrode line group $Y_{G1}$ and the even-numbered XY-electrode line pairs of the recently addressed second display electrode line group $Y_{G2}$ may cause all of the selected display cells to generate a display-sustain discharge.

The operation of each of the second-type sub-fields SF2, SF4, and SF6 is now set forth.

The reset periods R2, R4 and R6 provide substantially uniform electric charges for all display cells.

The addressing periods A3, A7, and A11 generate a fixed wall voltage for selected display cells of the second display electrode line group $Y_{G2}$. In the display-sustain periods S3, S7, and S11 for the second display electrode line group $Y_{G2}$, applying a fixed alternating voltage to the even-numbered XY-electrode line pairs of the addressed second display electrode line group $Y_{G2}$ may cause a display-sustain discharge in the display cells selected in addressing period A3, A7, and A11. Similarly, the addressing periods A4, A8, and A12 generate a fixed wall voltage for selected display cells of the first display electrode line group $Y_{G1}$. In the common display-sustain periods S4, S8, and S12 for the first and second display electrode line groups $Y_{G1}$ and $Y_{G2}$, applying a fixed alternating voltage to the even-numbered XY-electrode line pairs of the second display electrode line group $Y_{G2}$ and the odd-numbered XY-electrode line pairs of the recently addressed first display electrode line group $Y_{G1}$ may cause all of the selected display cells to generate a display-sustain discharge.

Display-sustain periods S13, S14 and S15 of sub-fields SF7, SF8 and SF9, which have the highest gray scale weighting, may be equally weighted. Accordingly, the possibility of pseudo-contour noise occurring, which users may see when watching a video with a time-sharing driving scheme, may be reduced.

The sub-fields SF7, SF8 and SF9 respectively and sequentially include addressing periods A13, A14, and A15 and display-sustain periods S13, S14, and S15 for the first and second display electrode line groups $Y_{G1}$ and $Y_{G2}$. The seventh sub-field SF7 may have a reset period R7 before the addressing period A13. The eighth and ninth sub-fields SF8 and SF9, however, may not require a reset period since image data of the highest gray scale weighted sub-fields SF7, SF8 and SF9 are probably equal or similar to each other. Omitting such a strong reset discharge may improve contrast performance and reduce power consumption.

Figure 3:
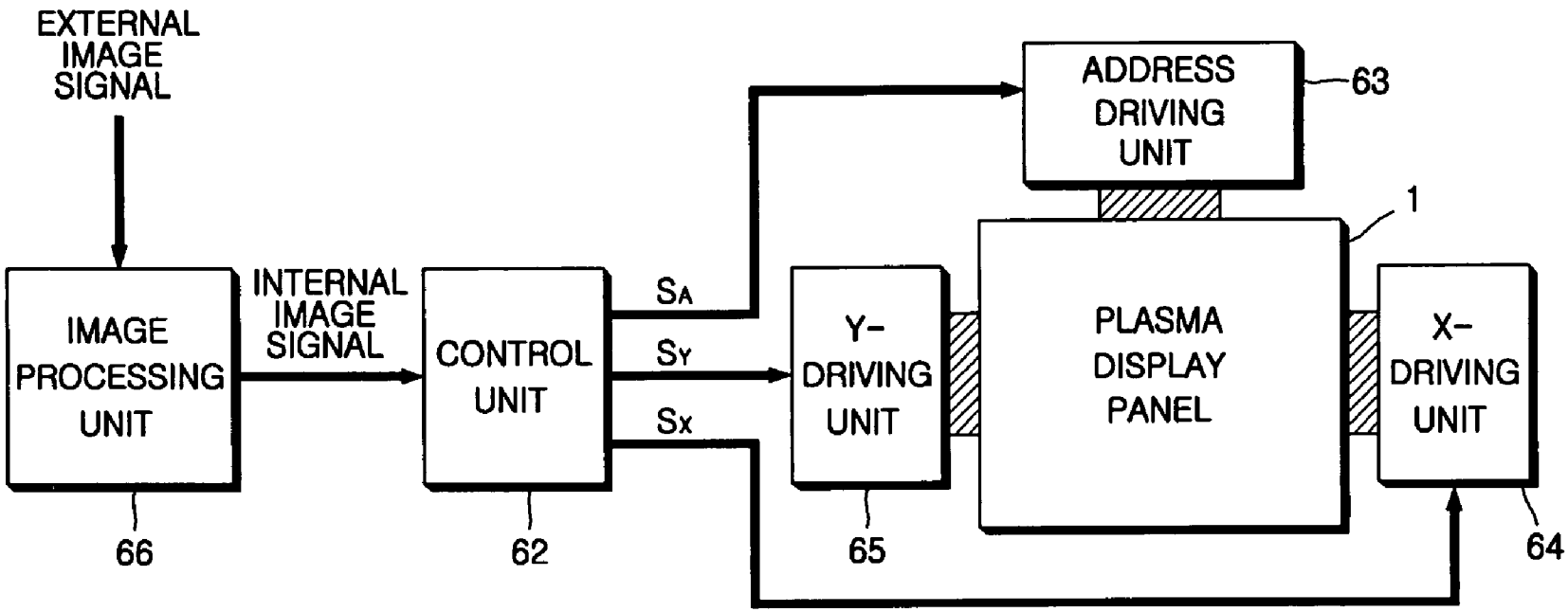
FIG. 3 (RELATED ART)
FIG. 3 is a block diagram showing a typical apparatus for driving the PDP shown in FIG. 1.
Figure 5:
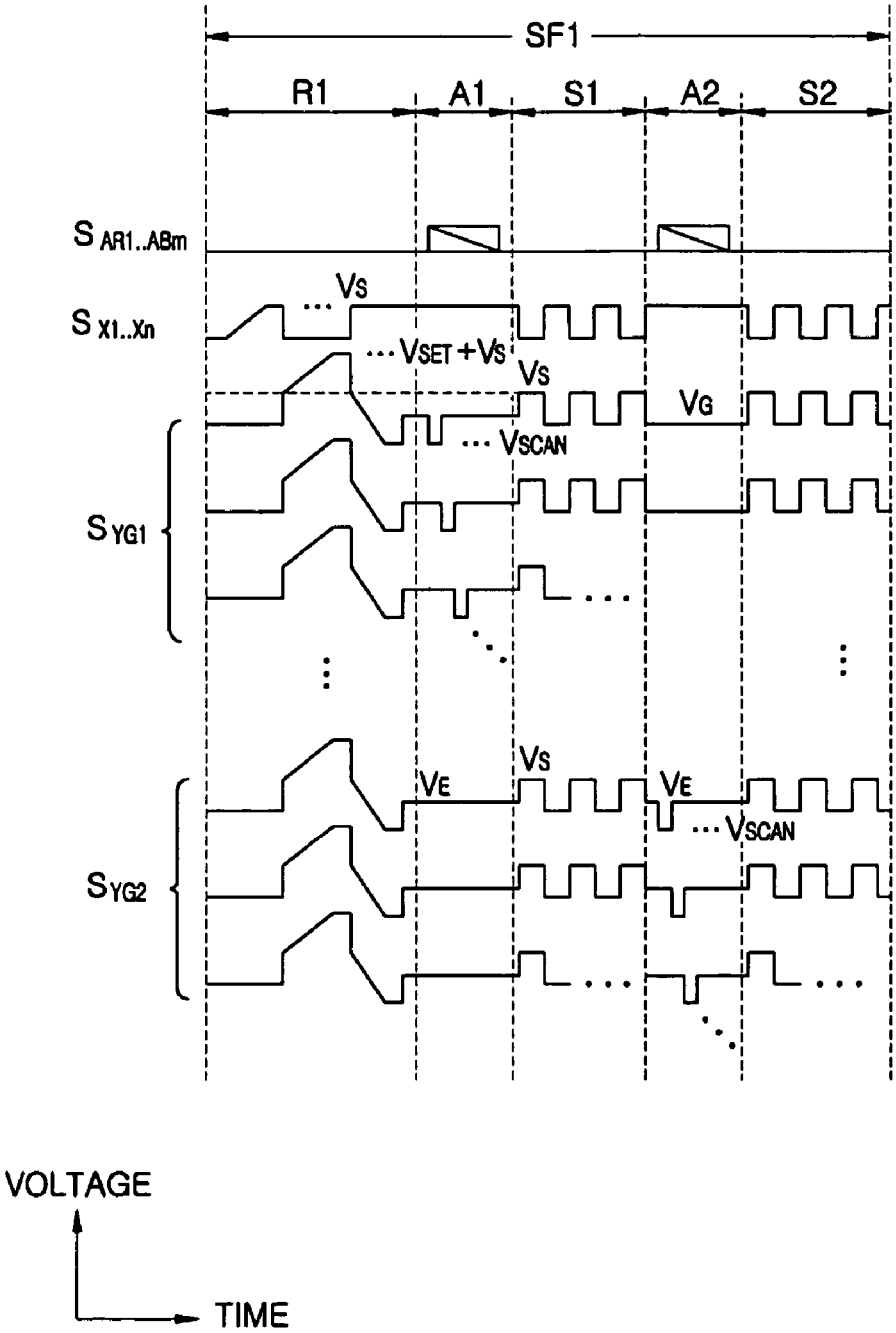
FIG. 5 is a timing diagram showing voltage waveforms of driving signals applied in sub-fields SF1, SF3, and SF5 of FIG. 4.

FIG. 5 shows voltage waveforms of driving signals that may be applied to the electrode lines in the first-type sub-fields SF1, SF3, and SF5 shown in FIG. 4. $S_{AR1 \ldots ABm}$ denotes display data signals that the address driving unit (reference numeral 63 in FIG. 3) may apply to the address electrode lines ($A_{R1}$ through $A_{Bm}$ in FIG. 1). $S_{X1}$ through $S_{Xn}$ denote driving signals that the X driving unit (reference numeral 64 in FIG. 3) may apply to the X-electrode lines ($X_1, \ldots, X_n$ in FIG. 1). $S_{YG1}$ and $S_{YG2}$ denote driving signals that the Y driving unit (reference numeral 65 in FIG. 3) may apply to the first and second display electrode line groups $Y_{G1}$ and $Y_{G2}$. R1 denotes the reset period, A1 and A2 denote addressing periods, and S1 and S2 denote display-sustain periods. The operation of each first-type sub-field SF1, SF3, and SF5 in FIG. 4 will be now described in detail with reference to FIG. 4 and FIG. 5.

In a first period of the reset period R1, a voltage applied to X-electrode lines $X_1, \ldots, X_n$ may gradually increase from a ground voltage $V_G$ to a second voltage $V_S$. Here, the ground voltage $V_G$, which is a third voltage, may be applied to Y-electrode lines $Y_1, \ldots, Y_n$ and address electrode lines $A_{R1}, \ldots, A_{Bm}$. Accordingly, a weak discharge may occur between X-electrode lines $X_1, \ldots, X_n$ and Y-electrode lines $Y_1, \ldots, Y_n$, and between X-electrode lines $X_1, \ldots, X_n$ and address electrode lines $A_1, \ldots, A_m$, thereby creating negative wall charges around the X-electrode lines $X_1, \ldots, X_n$.

Figure 8:
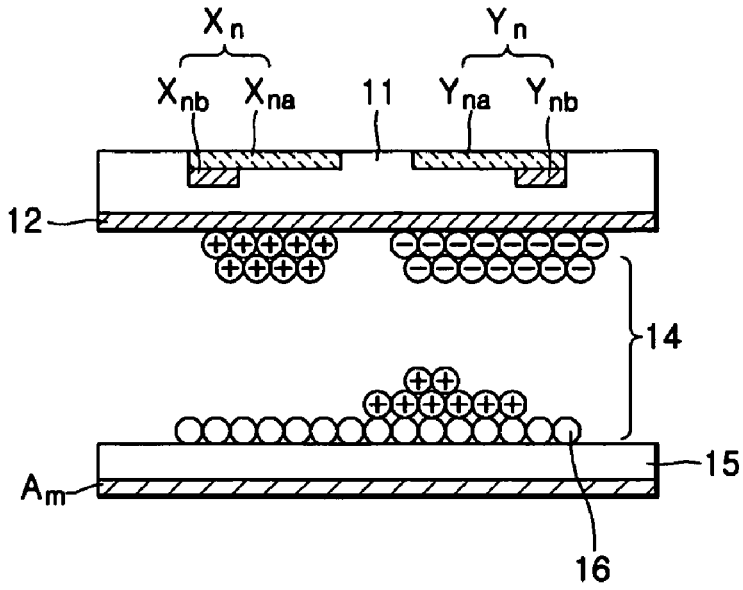
FIG. 8 is a sectional view showing a wall charge distribution of a display cell immediately after applying a gradually rising voltage to Y-electrode lines in a reset period of FIG. 5, FIG. 6 and FIG. 7.

In a second period of the reset period R1, which is a wall charge accumulating period, a voltage applied to Y-electrode lines $Y_1, \ldots, Y_n$ may gradually increase from the second voltage $V_S$ to a first voltage $V_{SET}+V_S$, which is higher than the second voltage $V_S$ by the sixth voltage $V_{SET}$. Here, the ground voltage $V_G$ may be applied to X-electrode lines $X_1, \ldots, X_n$ and address electrode lines $A_{R1}, \ldots, A_{Bm}$. Accordingly, a weak discharge may occur between Y-electrode lines $Y_1, \ldots, Y_n$ and X-electrode lines $X_1, \ldots, X_n$, while a weaker discharge may occur between Y-electrode lines $Y_1, \ldots, Y_n$ and address electrode lines $A_{R1}, \ldots, A_{Bm}$. Here, the discharge between Y-electrode lines $Y_1, \ldots, Y_n$ and X-electrode lines $X_1, \ldots, X_n$ may be stronger than the discharge between Y-electrode lines $Y_1, \ldots, Y_n$ and address electrode lines $A_{R1}, \ldots, A_{Bm}$ because of the previously formed negative wall charges around the X-electrode lines $X_1, \ldots, X_n$. Therefore, as FIG. 8 shows, many negative wall charges may be formed around the Y-electrode lines $Y_1, \ldots, Y_n$, positive wall charges may be formed around the X-electrode lines $X_1, \ldots, X_n$, and a few positive wall charges may be formed around the address electrode lines $A_{R1}, \ldots, A_{Bm}$.

Figure 9:
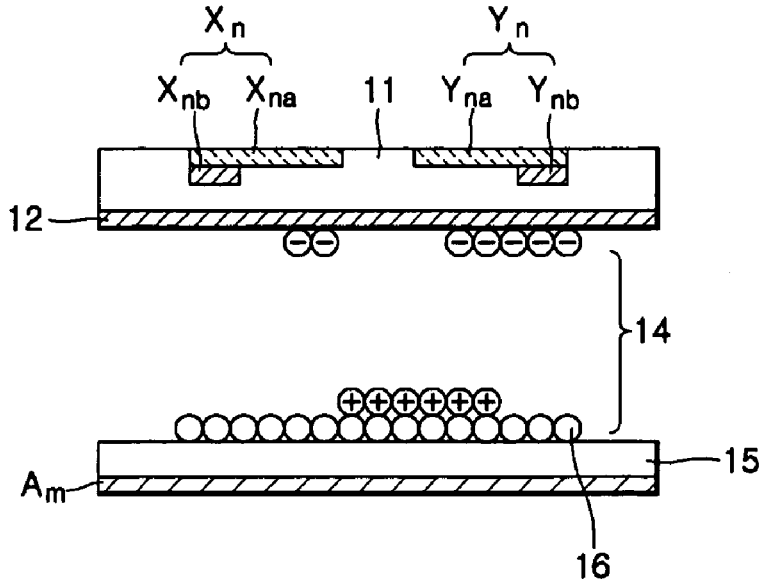
FIG. 9 is a sectional view showing a wall charge distribution of a display cell when the reset period of FIG. 5, FIG. 6 and FIG. 7 ends.

In a third period of the reset period R1, which is a wall charge distributing period, a voltage applied to X-electrode lines $X_1, \ldots, X_n$ may be maintained at the second voltage $V_S$, while a voltage applied to Y-electrode lines $Y_1, \ldots, Y_n$ may gradually decrease from the second voltage $V_S$ to a negative voltage $V_{SCAN}$. Here, the ground voltage $V_G$ may be applied to address electrode lines $A_{R1}, \ldots, A_{Bm}$. Accordingly, as FIG. 9 shows, due to a weak discharge between X-electrode lines $X_1, \ldots, X_n$ and Y-electrode lines $Y_1, \ldots, Y_n$, some negative wall charges around the Y-electrode lines $Y_1, \ldots, Y_n$ may move to the vicinity of the X-electrode lines $X_1, \ldots, X_n$.

Consequently, the wall potential of the X-electrode lines $X_1, \ldots, X_n$ may be less than that of the address electrode lines $A_{R1}, \ldots, A_{Bm}$, and may be greater than that of the Y-electrode lines $Y_1, \ldots, Y_n$. Therefore, an addressing voltage required for an opposing discharge between address electrode lines, which are selected in the following addressing periods A1 and A2, and Y-electrode lines may decrease.

In the addressing period A1 for the first display electrode line group $Y_{G1}$, a voltage applied to the X-electrode lines $X_1, \ldots, X_n$ may be maintained at the second voltage $V_S$ while sequentially applying a negative scan voltage $V_{SCAN}$ to the odd-numbered Y-electrode lines of the first display electrode line group $Y_{G1}$. Simultaneously, display data signals may be applied to the address electrode lines $A_{R1}, \ldots, A_{Bm}$. Accordingly, a fixed wall voltage may be created for the selected display cells in the first display electrode line group $Y_{G1}$. More specifically, a positive wall potential may be created around Y-electrodes of the selected display cells, and a negative wall potential may be created around the address electrodes. A positive bias voltage $V_E$ may be applied to all of the Y-electrode lines $Y_1, \ldots, Y_n$ when not applying the scan voltage thereto.

In the display-sustain period S1 for the first display electrode line group $Y_{G1}$, a voltage may be alternately applied to X and Y-electrode lines of the first display electrode line group $Y_{G1}$ More specifically, a pulse with the second voltage $V_S$ may be alternately applied to X-electrode lines and odd-numbered Y-electrode lines of the first display electrode line group $Y_{G1}$.

The addressing period A2 for the second display electrode line group $Y_{G2}$ and the common display-sustain period S2 for the first and second display electrode line groups $Y_{G1}$ and $Y_{G2}$ progress according to the aforementioned driving method.

Figure 6:
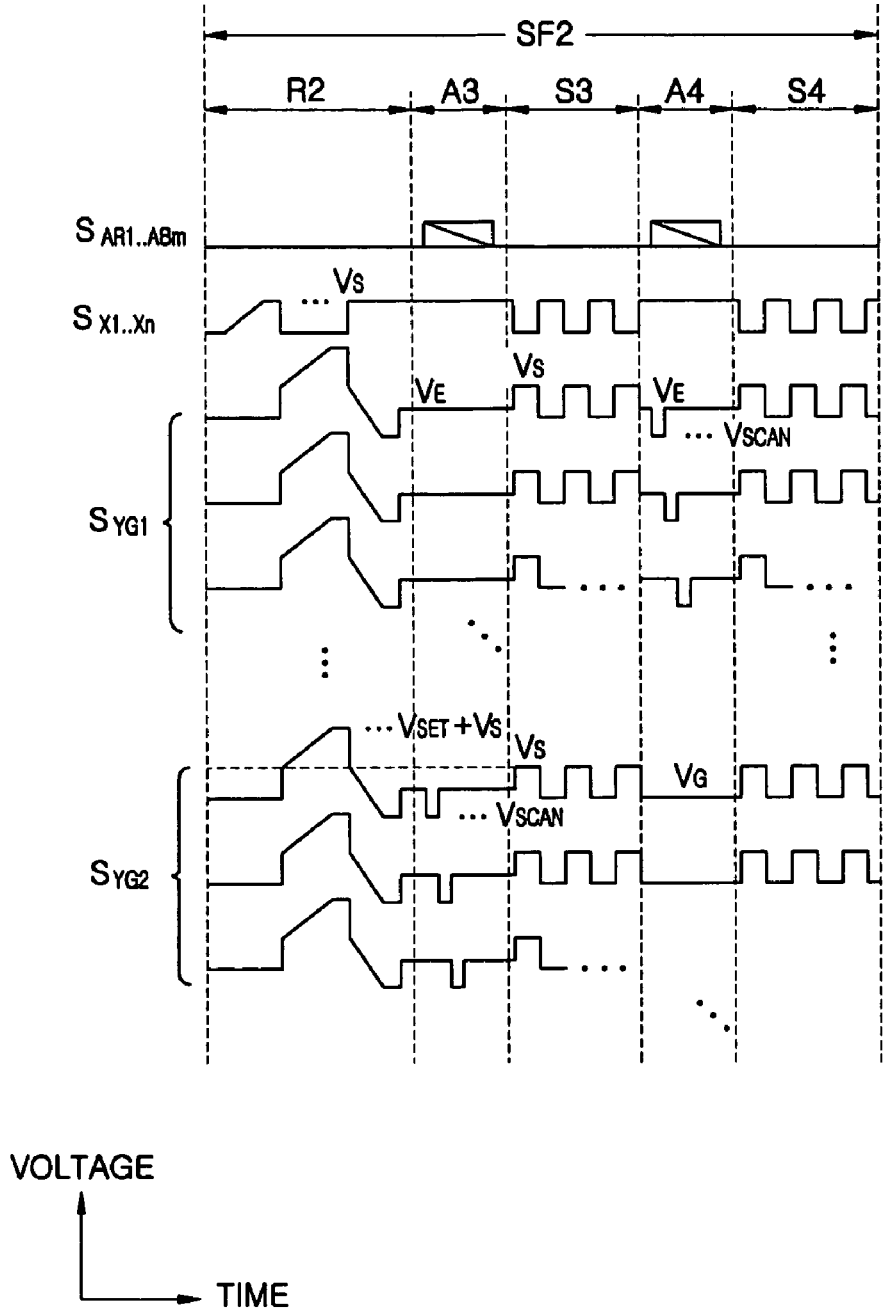
FIG. 6 is a timing diagram showing voltage waveforms of driving signals applied in sub-fields SF2, SF4, and SF6 of FIG. 4.

FIG. 6 shows voltage waveforms of driving signals that may be applied to the electrode lines in the second-type sub-fields SF2, SF4, and SF6 shown in FIG. 4. The same reference numerals in FIG. 5 and FIG. 6 denote signals with the same functions. The operation of each of the second-type sub-fields SF2, SF4, and SF6 in FIG. 4 will be now described in detail with reference to FIG. 4 and FIG. 6.

The reset period R2 may operate the same as the reset period R1 of FIG. 5.

In the addressing period A3 for the second display electrode line group $Y_{G2}$, a voltage applied to all of the X-electrode lines $X_1, \ldots, X_n$ may be maintained at the second voltage $V_S$, while sequentially applying a negative scan voltage $V_{SCAN}$ to even-numbered Y-electrode lines of the second display electrode line group $Y_{G2}$. Simultaneously, display data signals may be applied to the address electrode lines $A_{R1}, \ldots, A_{Bm}$. Accordingly, a fixed wall voltage may be created for selected display cells in the second display electrode line group $Y_{G2}$. More specifically, a positive wall potential may be created around Y-electrodes of the selected display cells, and a negative wall potential may be created around the address electrodes. A positive bias voltage $V_E$ may be applied to all of the Y-electrode lines $Y_1, \ldots, Y_n$ when not applying the scan voltage thereto.

In the display-sustain period S3 for the second display electrode line group $Y_{G2}$, a voltage may be alternately applied to X and Y-electrode lines of the second display electrode line group $Y_{G2}$. More specifically, a pulse with the second voltage $V_S$ may be alternately applied to X-electrode lines and even-numbered Y-electrode lines of the second display electrode line group $Y_{G2}$.

The addressing period A4 for the first display electrode line group $Y_{G1}$ and the common display-sustain period S4 for the first and second display electrode line groups $Y_{G1}$ and $Y_{G2}$ progress according to the aforementioned driving method.

Figure 7:
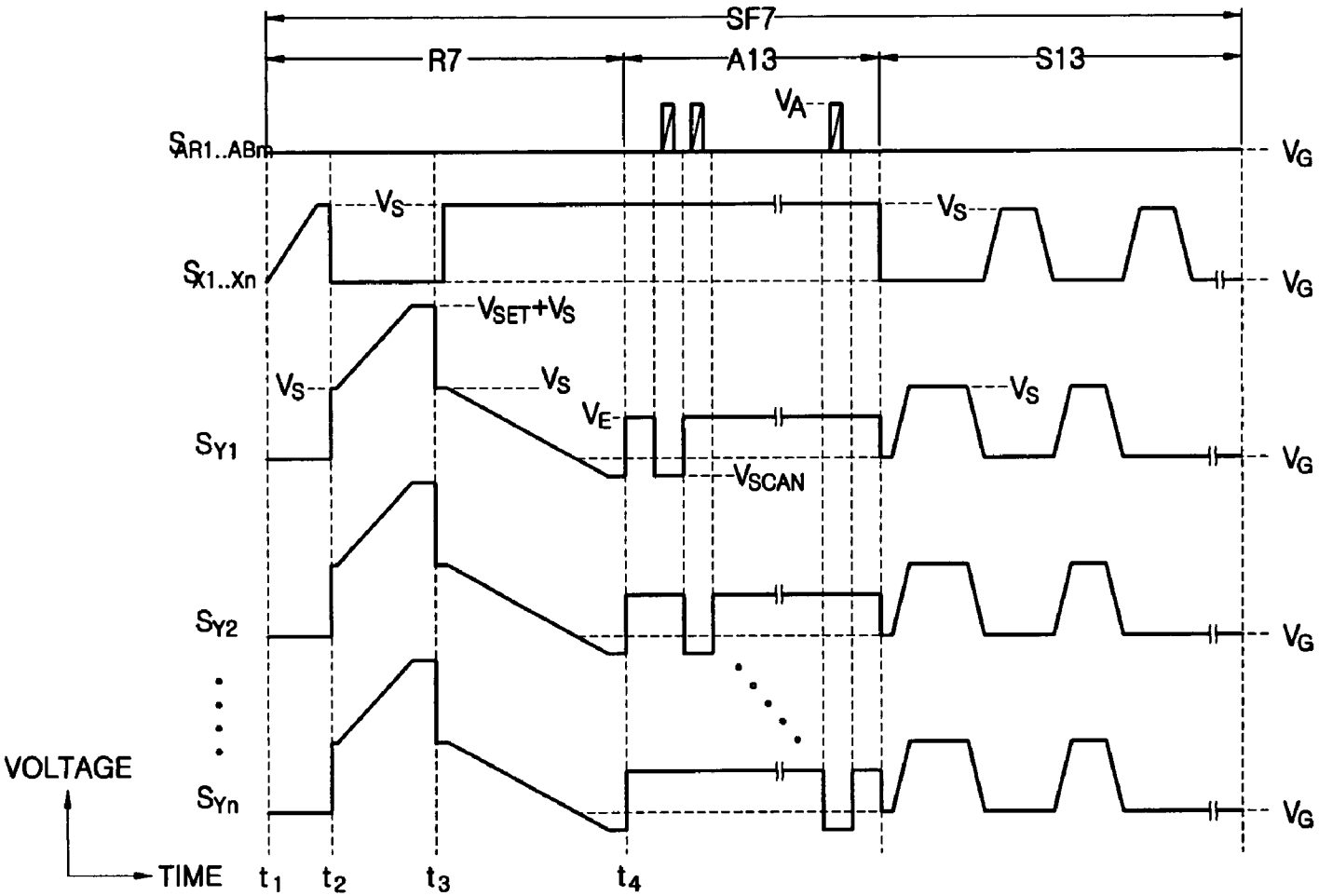
FIG. 7 is a timing diagram showing voltage waveforms of driving signals applied in sub-field SF7 of FIG. 4.

The same reference numerals in FIG. 7 as in FIG. 5 and FIG. 6 denote signals with the same functions. In FIG. 7, $S_{Y1}$, denotes a driving signal that may be applied to a first Y-electrode line $Y_1$, $S_{Y2}$ denotes a driving signal that may be applied to a second Y-electrode line $Y_2$, and $S_{Yn}$ denotes a driving signal that may applied to an n-th Y-electrode line $Y_n$. The operation of a leading sub-field SF7 among the three sub-fields SF7, SF8, and SF9 having an equal display-sustain period will be now described in detail with reference to FIG. 4 and FIG. 7.

The reset period R7, may operate the same as the reset period R1 of FIG. 5.

In the addressing period A13 for the first and second display electrode line groups $Y_{G1}$ and $Y_{G2}$, a voltage applied to X-electrode lines $X_1, \ldots, X_n$ may be maintained at the second voltage $V_S$, while sequentially applying a negative scan voltage $V_{SCAN}$ to all of the Y-electrode lines $Y_1, \ldots, Y_n$ Simultaneously, display data signals may be applied to the address electrode lines $A_{R1}, \ldots, A_{Bm}$. Accordingly, a fixed wall voltage may be created for selected display cells in the first and second display electrode line groups $Y_{G1}$ and $Y_{G2}$. More specifically, a positive wall potential may be created around Y-electrodes of the selected display cells, and a negative wall potential may be created around the address electrodes. A positive bias voltage $V_E$ may be applied to all of the Y-electrode lines $Y_1, \ldots, Y_n$ when not applying the scan voltage thereto.

In the display-sustain period S13 for the first and second display electrode line groups $Y_{G1}$ and $Y_{G2}$, a voltage may be alternately applied between X-electrode lines $X_1, \ldots, X_n$ and Y-electrode lines $Y_1, \ldots, Y_n$. More specifically, a positive pulse with the second voltage $V_S$ may be alternately applied to the X-electrode lines $X_1, \ldots, X_n$ and Y-electrode lines $Y_1, \ldots, Y_n$.

The gray scales that may be displayed in the unit frame of FIG. 4 may be described with reference to FIG. 4 and FIG. 10.

Figure 10:
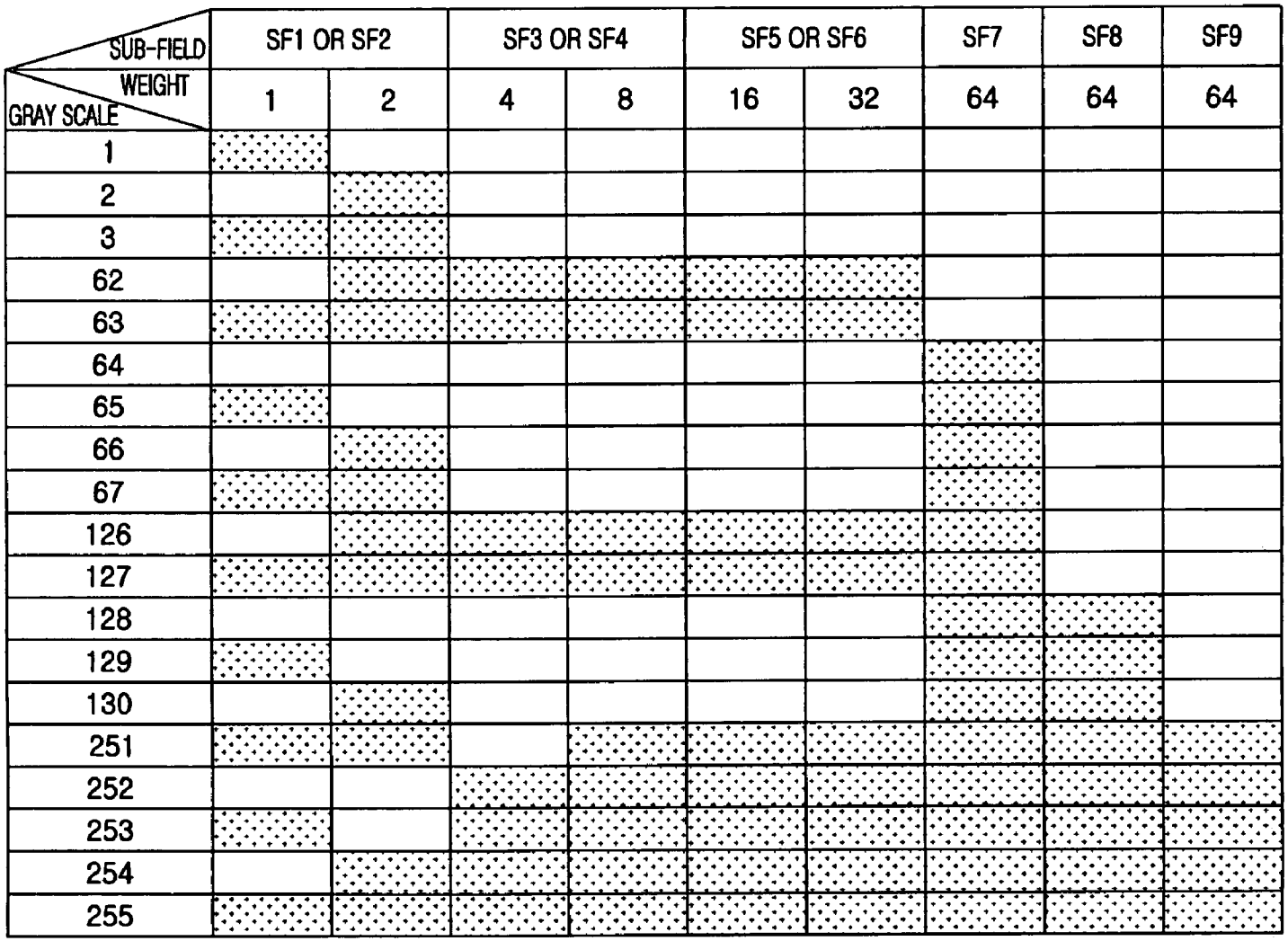
FIG. 10 is a diagram showing an example of gray scales displayed in the unit frame of FIG. 4.

Referring to FIG. 4 and FIG. 10, when a gray scale of a display cell in the first display electrode line group $Y_{G1}$ is '1', this display cell may be selected and displayed only in the second sub-field SF2. On the contrary, when a gray scale of a display cell in the second display electrode line group $Y_{G2}$ is '1', this display cell may be selected and displayed only in the first sub-field SF1.

When a gray scale of a display cell in the first display electrode line group $Y_{G1}$ is '2', this display cell may be selected and displayed only in the first sub-field SF1. On the contrary, when a gray scale of a display cell in the second display electrode line group $Y_{G2}$ is '2', this display cell may be selected and displayed only in the second sub-field SF2.

Accordingly, when a gray scale of a display cell in the first and second display electrode line groups $Y_{G1}$ and $Y_{G2}$ is '3', this display cell may be selected and displayed only in the first and second sub-fields SF1 and SF2.

According to a method of driving a discharge display panel of exemplary embodiments of the present invention, in the first-type sub-fields, after completing an addressing operation for the first display electrode line group, the group is display-sustain discharged before performing an addressing operation for the second display electrode line group. Similarly, in the second type sub-fields, after completing an addressing operation for the second display electrode line group, the group is display-sustain discharged before performing an addressing operation for the first display electrode line group. Consequently, the time between addressing and display sustain-discharging of selected display cells is reduced, which may increase the accuracy of the display-sustain discharge.

Additionally, since a display-sustain period of at least two sub-fields in the unit frame are equal to each other, the possibility of pseudo-contour noise occurring may be reduced.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method for driving a discharge display panel performing a gray scale display operation of a unit frame with a time-sharing driving scheme, where the panel comprises scan electrodes and sustain electrodes alternately arranged in rows on a first substrate and address electrodes arranged on a second substrate in a direction substantially orthogonal to the scan electrodes and the sustain electrodes, the method comprising:

dividing the unit frame into at least one first type sub-field, one second type sub-field, and at least two sub-fields having equally weighted display-sustain periods, the at least two subfields being different sub-fields than the first type sub-field and the second type sub-field;

grouping the scan electrodes into at least a first scan electrode group and a second scan electrode group;

in the first type sub-field, addressing the first scan electrode group;

sustain discharging the first scan electrode group;

addressing the second scan electrode group; and sustain discharging the first scan electrode group and the second scan electrode group; and in the second type sub-field, addressing the second scan electrode group;

sustain discharging the second scan electrode group;

addressing the first scan electrode group; and sustain discharging the first scan electrode group and the second scan electrode group.

2. The method of claim 1, wherein sustain discharging the first scan electrode group generates a display-sustain discharge in selected display cells of the first scan electrode group; and wherein sustain discharging the second scan electrode group generates a display-sustain discharge in selected display cells of the second scan electrode group.

3. The method of claim 2, wherein sustain discharging the first scan electrode group comprises alternately applying a voltage to scan electrodes of the first scan electrode group and to the sustain electrodes; and wherein sustain discharging the second scan electrode group comprises alternately applying a voltage to scan electrodes of the second scan electrode group and to the sustain electrodes.

4. The method of claim 1, further comprising:

in the first sub-field, resetting all panel cells before addressing the first scan electrode group; and in the second type sub-field, resetting all panel cells before addressing the second scan electrode group.

5. The method of claim 1, wherein dividing the unit frame further comprises setting a total display-sustain period of the first scan electrode group equal to a total display-sustain period of the second scan electrode group.

6. The method of claim 1, wherein dividing the unit frame further comprises, dividing the unit frame into first through 'n'-th sub-fields with gradually increasing gray scale weightings;

using the first type sub-field and the second type sub-field in the first through 'n-i'-th sub-fields; and setting display-sustain periods of the 'n-i+1'-th through 'n'-th sub-fields with equal weight, wherein 'n' is an integer of 4 or more; and wherein 'i' is an integer of 2 or more.

7. The method of claim 1, further comprising:

in the sub-fields having equally weighted display-sustain periods, addressing the first scan electrode group and the second scan electrode group; and sustain discharging the first scan electrode group and the second scan electrode group.

8. The method of claim 7, further comprising:

in only a leading sub-field among the sub-fields having equally weighted display-sustain periods, resetting all panel cells before addressing the first scan electrode group and the second scan electrode group.

9. A method for driving a discharge display panel performing a gray scale display operation of a unit frame including a plurality of sub-fields with a time-sharing driving scheme, where the panel comprises display electrode line pairs in parallel to each other and address electrode lines separated from and crossing the display electrode line pairs, the method comprising:

driving display electrode line pairs grouped by at least a first display electrode line group and a second display electrode line group so that at least one display electrode line pair is included in a display electrode line group, wherein the unit frame comprises at least a first type sub-field a second type sub-field, and at least two sub-fields having equally weighted display-sustain periods, the at least two subfields being different subfields than the first type sub-field and the second type sub-field;

wherein at least one of the first type sub-field sequentially comprises an addressing period for the first display electrode line group, a display-sustain period for the first display electrode line group, an addressing period for the second display electrode line group, and a display-sustain period for the first display electrode line group and the second display electrode line group; and wherein at least one of the second type sub-field sequentially comprises an addressing period for the second display electrode line group, a display-sustain period for the second display electrode line group, an addressing period for the first display electrode line group, and a display-sustain period for the first display electrode line group and the second display electrode line group.

10. The method of claim 9, wherein in a display-sustain period for the first display electrode line group, a display-sustain discharge is generated in selected display cells of the first display electrode line group.

11. The method of claim 10, wherein in the display-sustain period for the first display electrode line group, a voltage is alternately applied to electrodes of a display electrode line pair of the first display electrode line group.

12. The method of claim 9, wherein in a display-sustain period for the second display electrode line group, a display-sustain discharge is generated in selected display cells of the second display electrode line group.

13. The method of claim 12, wherein in the display-sustain period for the second display electrode line group, a voltage is alternately applied to electrodes of a display electrode line pair of the second display electrode line group.

14. The method of claim 9, wherein the first type sub-field further comprises a reset period where electric charges of all display cells in the first display electrode line group and the second display electrode line group are made substantially uniform before the addressing period for the first display electrode line group.

15. The method of claim 9, wherein the second type sub-field further comprises a reset period where electric charges of all display cells in the first display electrode line group and the second display electrode line group are made substantially uniform before the addressing period for the second display electrode line group.

16. The method of claim 9, wherein, in the unit frame, a total display-sustain period of the first display electrode line group equals a total display-sustain period of the second display electrode line group.

17. The method of claim 9, wherein the unit frame comprises first through 'n'th sub-fields with gradually increasing gray scale weightings;

wherein the first type sub-field and the second type sub-field are used in the first through 'n-i'-th sub-fields;

wherein display-sustain periods of the 'n-i+1'-th through 'n'-th sub-fields are equally weighted;

wherein 'n' is an integer of 4 or more; and wherein 'i' is an integer of 2 or more.

18. The method of claim 9, wherein at least two sub-fields having equally weighted display sustain periods sequentially comprise:

an addressing period for the first display electrode line group and the second display electrode line group; and a display-sustain period for the first display electrode line group and the second display electrode line group.

19. The method of claim 18, wherein only a leading sub-field among the sub-fields having equally weighted display-sustain periods further comprises a reset period before the addressing period.

* * * * *